US009369806B2

(12) United States Patent
Wang et al.

(10) Patent No.: US 9,369,806 B2
(45) Date of Patent: Jun. 14, 2016

(54) MOVING-COIL ELECTROACOUSTIC TRANSDUCER

(75) Inventors: Jianjian Wang, Weifang (CN); Ze Wang, Weifang (CN); Chengfei Zhang, Weifang (CN); Lianshan Ge, Weifang (CN); Chunfa Liu, Weifang (CN)

(73) Assignee: Goertek, Inc., Weifang, Shandong Province (CN)

( * ) Notice: Subject to any disclaimer, the term of this patent is extended or adjusted under 35 U.S.C. 154(b) by 102 days.

(21) Appl. No.: 14/239,602

(22) PCT Filed: Dec. 26, 2011

(86) PCT No.: PCT/CN2011/084678

§ 371 (c)(1), (2), (4) Date: Mar. 26, 2014

(87) PCT Pub. No.: WO2013/026246

PCT Pub. Date: Feb. 28, 2013

(65) Prior Publication Data

US 2015/0146912 A1 May 28, 2015

(30) Foreign Application Priority Data

Aug. 19, 2011 (CN) ..... 2011 2 0303714 U

(51) Int. Cl.

| | |
|---|---|
| ***H04R 9/04*** | (2006.01) |
| ***H04R 9/06*** | (2006.01) |
| ***H04R 31/00*** | (2006.01) |
| *H04R 7/16* | (2006.01) |
| *H04R 7/18* | (2006.01) |

(52) U.S. Cl.

CPC ..... *H04R 9/04* (2013.01); *H04R 9/041* (2013.01); *H04R 9/043* (2013.01); *H04R 9/045* (2013.01); *H04R 9/046* (2013.01); *H04R 9/06* (2013.01); *H04R 31/006* (2013.01); *H04R 7/16* (2013.01); *H04R 7/18* (2013.01); *H04R 2231/003* (2013.01); *H04R 2400/11* (2013.01)

(58) Field of Classification Search

CPC ..... H04R 9/04; H04R 9/041; H04R 9/043; H04R 9/045; H04R 7/16; H04R 7/18; H04R 2231/001; H04R 2231/003; H04R 31/003; H04R 31/006; H04R 2400/11; H04R 1/28; H04R 1/2869; H04R 1/2884; H04R 1/2892

See application file for complete search history.

(56) References Cited

U.S. PATENT DOCUMENTS 5,717,775 A * 2/1998 Sakamoto et al. ..... 381/400

FOREIGN PATENT DOCUMENTS

| | | |
|---|---|---|
| CN | 201657279 | 11/2010 |
| CN | 201657281 | 11/2010 |

(Continued)

OTHER PUBLICATIONS

PCT/CN2011/084678, Written Opinion of the International Search Authority, dated Apr. 12, 2012.

*Primary Examiner* — Curtis Kuntz
*Assistant Examiner* — Joshua Kaufman
(74) *Attorney, Agent, or Firm* — Boyle Fredrickson, S.C.

(57) ABSTRACT

A moving-coil electroacoustic transducer is provided which is bar-shaped and includes a vibration system. The vibration system includes a vibration diaphragm, a bar-shaped acoustic coil, an acoustic coil support, and two plucked members. The acoustic coil sleeves the acoustic coil support and is combined with the vibration diaphragm through the acoustic coil support. The acoustic coil support is integrally formed; and includes an acoustic coil mounting portion located in the middle, dampening member mounting portions located at the two ends, and a support portion disposed between two long-axis edges of the acoustic coil mounting portion.

8 Claims, 3 Drawing Sheets

(56) References Cited

FOREIGN PATENT DOCUMENTS

| | | |
|---|---|---|
| CN | 201657281 U | 11/2010 |
| CN | 201699968 | 1/2011 |
| CN | 201708913 | 1/2011 |
| CN | 201708913 U | 1/2011 |
| CN | 202068566 | 12/2011 |
| JP | 10-145891 | 5/1998 |

* cited by examiner

MOVING-COIL ELECTROACOUSTIC TRANSDUCER

TECHNICAL FIELD

The present invention relates to the field of electroacoustic transducers, specifically relates to a moving-coil electroacoustic transducer.

BACKGROUND OF THE INVENTION

With the development of terminal consumer electronic products, more and more electroacoustic transducers, in particular, moving-coil electroacoustic transducers are widely applied. It is well known that the sound generating principle of the moving-coil electroacoustic transducer is that the acoustic coil applied with an alternating current signal is forced to vibrate in the magnetic field so as to cause the vibration diaphragm to generate sound. When the electric current flows through the acoustic coil, a varying magnetic field with the same frequency as the audio signal will be generated around the acoustic coil. The magnetic field generated by the acoustic coil and the magnetic field generated by the magnetic circuit system will act with each other so that the acoustic coil generates vibration deviating from the vertical direction, thereby generating biased vibration and resulting in distortion of the vibration system, which makes the operation of the vibration system unstable.

At present, the moving-coil electroacoustic transducer applied in electronic products such as LCD. PDP is generally designed as bar-shaped in order to ensure thinness of the terminal product design, and is designed With a acoustic coil support for ensuring effective length of the acoustic coil at the magnetic circuit portion, and is disposed with anti-biased vibration means such as plucked members, meanwhile the deformation problem of the long axis edges of the acoustic coil support needs to be considered. The coil framework design of the traditional structure cannot be balance the performance requirements of above said design, and a relatively complicated process and/or design is generally required.

So, it is necessary to make further improvement to said moving-coil electroacoustic transducer of the traditional structure so as to avoid said detect.

SUMMARY OF THE INVENTION

The technical problem to be solved by the present invention is to provide an acoustic coil support with good performance and simple process with respect to the bar-shaped moving-coil electroacoustic transducer, which can solve both of the problems of biased vibration and deformation of the long axis edges.

In order to solve said technical problem, the technical solution of the present invention is realized in this way:

The present invention discloses a moving-coil electroacoustic transducer, which is bar-shaped, the moving-coil electroacoustic transducer comprises a vibration system;

Said vibration system comprises: a vibration diaphragm (11), a bar-shaped acoustic coil (12), a acoustic coil support (2) and two plucked members (3); the acoustic coil (12) sleeves the acoustic coil support (2) and is combined with the vibration diaphragm (11) through the acoustic coil support (2);

Said acoustic coil support (2) is integrally formed, and comprises a acoustic coil mounting portion (22) located in the middle, plucked member mounting portions (21) located at the two ends and a support portion (23) disposed between two long-axis edges of said acoustic coil mounting portion (22).

Said moving-coil electroacoustic transducer further comprises: a magnetic circuit system;

said magnetic circuit system comprises a pole plate (41), a magnet (42) and a magnet yolk (43) combined together from top to bottom.

In said moving-coil electroacoustic transducer, said pole plate (41), magnet (42) and magnet yolk (43) are fixed therebetween through dispensing.

Said moving-coil electroacoustic transducer further comprises a housing (5);

The other fixing end of said dampening member (3) is fixed on the housing (5).

Said moving-coil electroacoustic transducer further comprises a flexible circuit board (6) for electrically connecting the acoustic coil (12).

In said moving-coil electroacoustic transducer, said support portion (23) is located at one end of the acoustic coil mounting portion (22) that is far away from said vibration diaphragm (11).

In said moving-coil electroacoustic transducer, said acoustic coil mounting portion (22) is provided with a recess portion (24) towards inside, said acoustic coil (12) sleeves said recess portion (24) correspondingly.

In said moving-coil electroacoustic transducer, the material of said plucked members (3) is formed by coating glue on fiber cloth.

In said moving-coil electroacoustic transducer, said acoustic coil support (20 is an aluminous acoustic coil support.

In said moving-coil electroacoustic transducer, the surface of said acoustic coil support (2) is coated with insulating varnish or hot melt adhesive.

By adopting said technical solution, the beneficial effect of the present invention is: by using the integrally formed acoustic coil support, and disposing the plucked member mounting portions at the two ends of the acoustic coil support, a support portion is disposed between two long-axis edges of the acoustic coil mounting portion, and the acoustic coil support can be formed integrally, so that the problems of biased vibration and deformation on the long-axis side is solved, and meanwhile the manufacturing process is simplified, thereby making the manufacturing simpler.

BRIEF DESCRIPTION OF THE DRAWINGS

Hereinafter, the present invention will be further explained with reference to the drawings and the embodiment.

Figure 1:
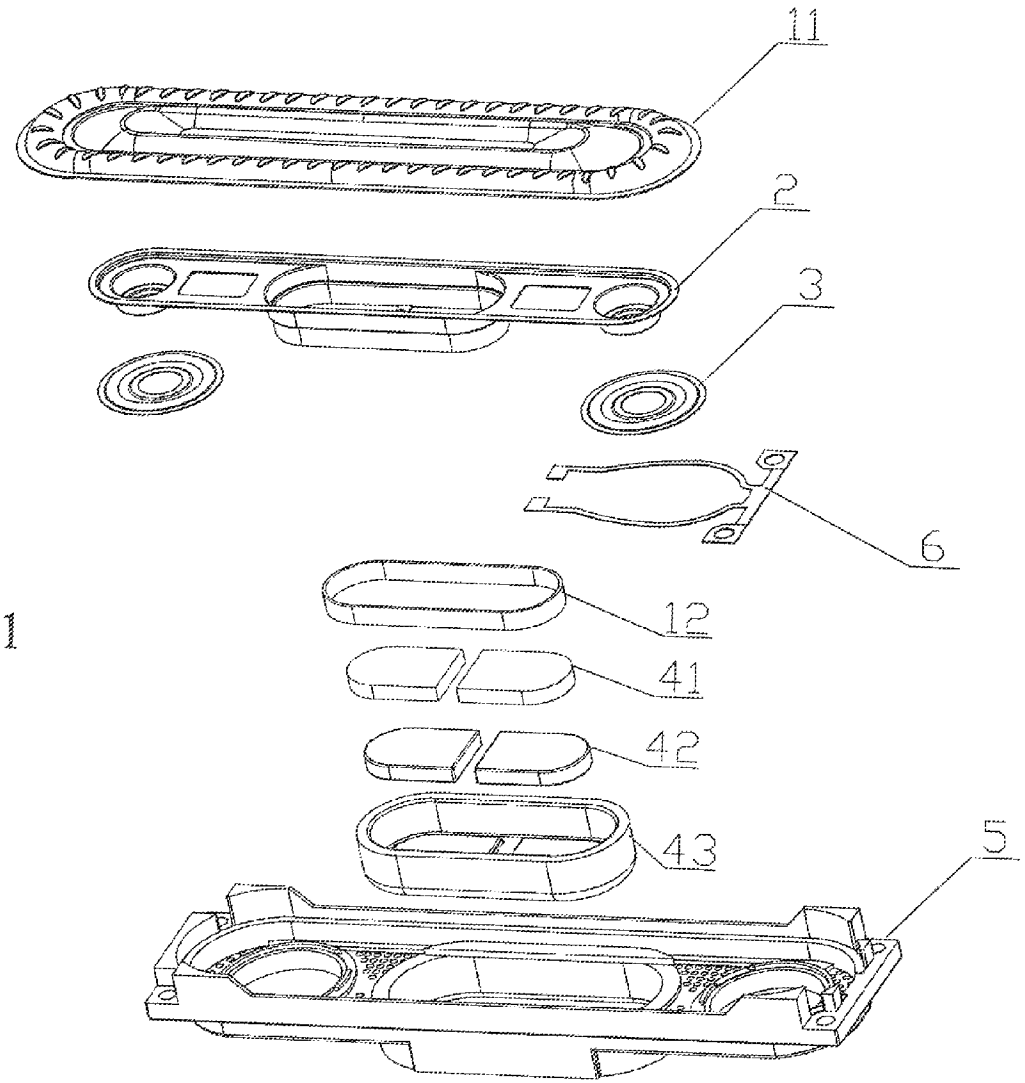
FIG. 1 is a schematic exploded view of a moving-coil electroacoustic transducer according to an embodiment of the present invention.

In the drawings, 11 vibration diaphragm; 12 acoustic coil; 2 acoustic coil support; 21 dampening member mounting portion; 22 acoustic coil mounting portion; 23 support portion; 3 dampening member; 41 pole plate; 42 magnet; 43 magnet yolk; 5 housing; 6 flexible circuit board.

MODES FOR CARRYING OUT THE INVENTION

In the following description, only some exemplary embodiments of the present invention are described illustratively. Undoubtedly, the skilled person in the art can appreciate that various manners can be used to modify the embodiments without departing from the spirit and scope of the present invention. Therefore, the drawings and the description are only illustrative in essence, rather than being used for limiting the protection scope of the claims. in addition, in this description, the same reference number indicates the same part.

Figure 2:
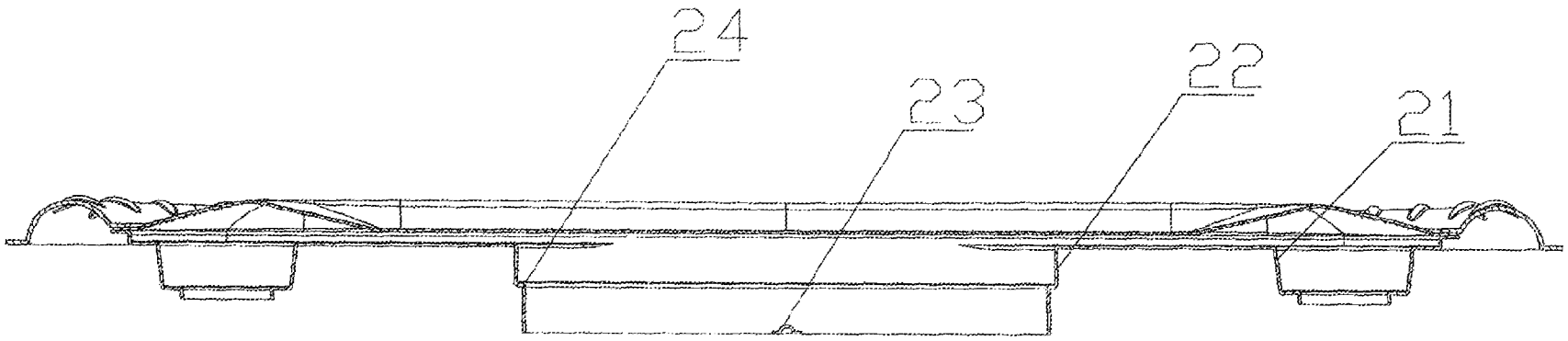
FIG. 2 is a sectional view of an acoustic coil support according to the embodiment of the present invention.
Figure 3:
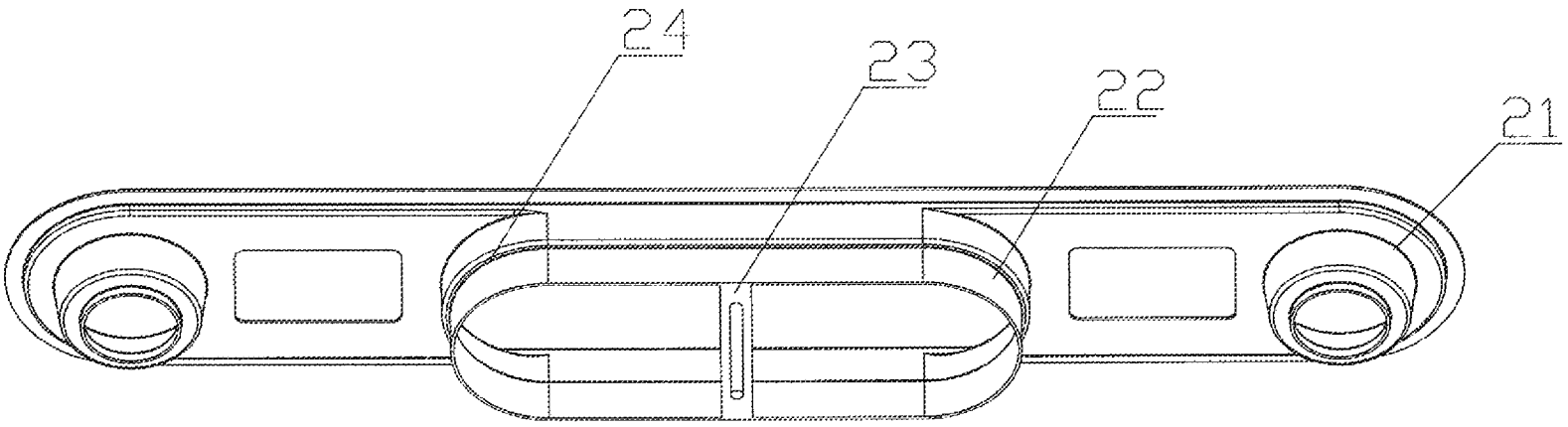
FIG. 3 is a perspective view of the acoustic coil support according to the embodiment of the present invention.

Embodiments:

As shown in FIGS. 1-3, a moving-coil electroacoustic transducer comprises a vibration system. The vibration system comprises a vibration diaphragm 11 and a bar-shaped acoustic coil 12. The vibration system is disposed with an acoustic coil support 2. The acoustic coil 12 sleeves the acoustic coil support 2 and is combined with the vibration diaphragm 11 through the acoustic coil support 2 so as to cause the vibration diaphragm 11 to vibrate up and down when the acoustic coil 12 is applied with an alternating current. The acoustic coil support 2 mainly ensures the position of the acoustic coil 12 in the moving-coil electroacoustic transducer, and prevents the acoustic coil 12 from generating biased vibration when vibrating, especially, vibrating at large power. The vibration system is further disposed with dampening members 3. The dampening members 3 are made from fiber cloth coated with glue, and are disposed at the two ends of the moving-coil electroacoustic transducer in its long-axis direction. Disposing the plucked members 3 on the moving-coil electroacoustic transducer can ensure the stability of the vibration system, and prevent vibration system from deviating from the vertical direction. In the present embodiment, the acoustic coil support 2 is integrally formed, and comprises a acoustic coil mounting portion 22 located in the middle, dampening member mounting portions 21 located at the two ends and a support portion 23 disposed between two long-axis edges of the acoustic coil mounting portion 22. Disposing the dampening member mounting portions 21 at the two ends can centre better the bar-shaped moving-coil electroacoustic transducer. The support portion 23 can support the long-axis edges of the acoustic coil mounting portion, so as to avoid distortion of the long-axis edges of the acoustic coil by bending inward due to its relatively long length. It is unnecessary to design acoustic coils and vibration diaphragm with the same length-width ratio. It is realized that the relatively short acoustic coil causes the relatively long vibration diaphragm to vibrate. Finally, a longer and narrower moving-coil electroacoustic transducer structure can be realized with relatively small difficulty of manufacturing the magnetic circuit and the acoustic coil, thereby meeting the requirement of the terminal products.

In the acoustic coil support design of such a structure, the acoustic coil support is integrally formed, and plucked member mounting portions are disposed at the two ends of the acoustic coil support, a support portion is disposed on the long axis edge of the acoustic coil mounting portion, such a acoustic coil support of complex structure can be formed integrally in manufacturing, the manufacturing process is simplified, meanwhile avoiding biased vibration and deformation of the long-axis edges.

The specific structure of the moving-coil electroacoustic transducer in the present embodiment further comprises the following parts: a magnetic circuit system for providing a stable magnetic field, providing a driving force for the acoustic coil 12 applied with an alternating current signals, and comprising a pole plate 41, a magnet 42 and a magnet yolk 43 combined together from top to bottom, the pole plate 41, magnet 42 and magnet yolk 43 being fixed therebetween through dispensing, the pole plate 41 being mainly used for correcting the magnetic line of the magnetic circuit system, the magnet 42 providing a permanent magnetic field, the magnet yolk 43 forming the external packaging structure of the moving-coil electroacoustic transducer while forming the pathway of the magnetic circuit system; and a housing 5 for correspondingly accommodating and fixing the vibration system and the magnetic circuit system. The acoustic coil support 2 is also combined with a flexible circuit board 6 for electrically connecting the acoustic coil 12. The other end of the flexible circuit board 6 is electrically connected to the external circuit. The flexible circuit board 6 plays the function of transfering the electric signals in the moving-coil electroacoustic transducer. The flexible circuit board has good flexibility and electric conduction property, which can prevent the moving-coil electroacoustic transducer from breaking in operation. In the present embodiment, the other fixing ends of the dampening members 3 are fixed on the housing 5, so as to centering the vibration system.

Moreover, a preferred design scheme of the present embodiment is that the acoustic coil support 2 is an aluminous acoustic coil support. The acoustic coil support of aluminum material is not only easy for processing but also relatively lighter, and can meet the production requirements and the product performance requirements better. When the moving-coil electroacoustic transducer works with a large power, the acoustic coil will generate large amount of heat, the aluminous acoustic coil support can dissipate the heat generated by the acoustic coil better, so as to avoid the acoustic coil from being damaged under high temperature.

Furthermore, a preferred design scheme of the present embodiment is that the support portion 23 is located at one end of the acoustic coil mounting portion 22 that is far away from the vibration diaphragm 11. The design that the support portion 23 is located at the bottom of the acoustic coil support can prevent the acoustic coil support from being deformed better, because the deformation pressure suffered by the bottom is greater.

In addition, a preferred design scheme of the present embodiment is that the acoustic coil mounting portion 22 is provided with a recess portion 24 towards inside, the acoustic coil 12 sleeves the recess portion 24 correspondingly. The recess portion can facilitate assembly of the acoustic coil and the acoustic coil support, meanwhile, it has the technical effect of enhancing the strength of the acoustic coil support.

In addition, a preferred design scheme of the present embodiment is that the surface of the acoustic coil support 2 is coated with insulating varnish or hot melt adhesive. Such a design can prevent the acoustic coil 12 and the acoustic coil support 2 from short circuit.

The basic principle, main features and advantages of the present invention have been illustrated and described. However, the skilled person in the art should appreciate that the present invention is not limited by the embodiments. The present invention can also have various modifications and improvements without departing from the spirit and scope of the present invention, and these modifications and improvements all fall within the protection scope of the present invention. The protection scope of the present invention is limited by the attached Claims and the equivalent thereof.

The invention claimed is:

1. A moving-coil electroacoustic transducer, which is bar-shaped, comprising:

a vibration system including:

a vibration diaphragm (11), a bar-shaped acoustic coil (12), an acoustic coil support (2) and two dampening members (3); the acoustic coil (12) sleeves the acoustic coil support (2) and is combined with the vibration diaphragm (11) through the acoustic coil support (2);

wherein the acoustic coil support (2) is integrally formed, and includes an acoustic coil mounting portion (22) located in a middle, dampening member mounting portions (21) located at two ends and a support portion (23) disposed between two long-axis edges of said acoustic coil mounting portion (22); wherein the support portion (23) is located at a first end of the acoustic coil mounting portion (22) that is spaced from the vibration diaphragm (11), the acoustic coil mounting portion (22) being provided with a recess portion (24) directed towards an interior of the vibration system, the acoustic coil (12) sleeves the recess portion (24) correspondingly.

2. The moving-coil elector acoustic transducer according to claim 1, wherein the moving-coil electroacoustic transducer further comprises a magnetic circuit system;

said magnetic circuit system comprises a pole plate (41), a magnet (42) and a magnet yoke (43) combined together from top to bottom.

3. The moving-coil electroacoustic transducer according to claim 2, wherein said pole plate (41), magnet (42) and magnet yoke (43) are fixed therebetween through an adhesive.

4. The moving-coil electroacoustic transducer according to claim 2, wherein the moving-coil electroacoustic transducer further comprises a housing (5);

the other fixing end of said dampening member (3) is fixed on the housing (5).

5. The moving-coil electroacoustic transducer according to claim 1, wherein the moving-coil electroacoustic transducer further comprises a flexible circuit board (6) for electrically connecting the acoustic coil (12).

6. The moving-coil electroacoustic transducer according to claim 1, wherein the material of said dampening members (3) is formed by coating glue on fiber cloth.

7. The moving-coil electroacoustic transducer according to claim 1, wherein said acoustic coil support (20) is an aluminous acoustic coil support.

8. The moving-coil electroacoustic transducer according to claim 1, wherein the surface of said acoustic coil support (2) is coated with insulating varnish or hot melt adhesive.

* * * * *